United States Patent [19]

Alesi, Jr.

[11] 4,075,803

[45] Feb. 28, 1978

[54] SPLIT DUCT TERMINATOR

[75] Inventor: John Alesi, Jr., Topanga, Calif.

[73] Assignee: Formex Manufacturing, Inc., Venice, Calif.

[21] Appl. No.: 699,507

[22] Filed: Jun. 24, 1976

[51] Int. Cl.[2] ..... E04C 1/39; E04B 5/48

[52] U.S. Cl. ..... 52/220; 52/577; 52/578

[58] Field of Search ..... 248/56; 52/20, 594, 52/687, 309.17, 221, 220, 5-18, 576, 577; 285/64, 192

[56] References Cited

U.S. PATENT DOCUMENTS

| | | | |
|---|---|---|---|
| 2,462,399 | 2/1949 | Hinchman | 52/687 |
| 3,731,448 | 5/1973 | Leo | 52/594 |
| 3,908,323 | 9/1975 | Stout | 52/221 |

*Primary Examiner*—Price C. Faw, Jr.
*Assistant Examiner*—James L. Ridgill, Jr.
*Attorney, Agent, or Firm*—Fulwider, Patton, Rieber, Lee & Utecht

[57] ABSTRACT

Split duct terminator apparatus is provided at the cable entrance of a subterranean manhole for receiving a plurality of cables extending between subterranean manholes along a cable path carrying electrical signal conductors for the transmission of telecommunication messages. A plurality of modules are provided at the cable entrance to the manhole to encircle and immobilize a plurality of conduits or ducts carrying the cables which laterally enter the vault while the cables are maintained in position and in service. The modules are positioned about the plurality of cables at a working distance from a splice case. Split duct sections encircle the cables where the cables appear at the manhole, but the duct sections are terminated at the manhole walls. Once positioned about the duct sections containing the cables, the modules are joined together in a composite structure. A coagulated mass which permeates the structure binds the modules together.

6 Claims, 5 Drawing Figures

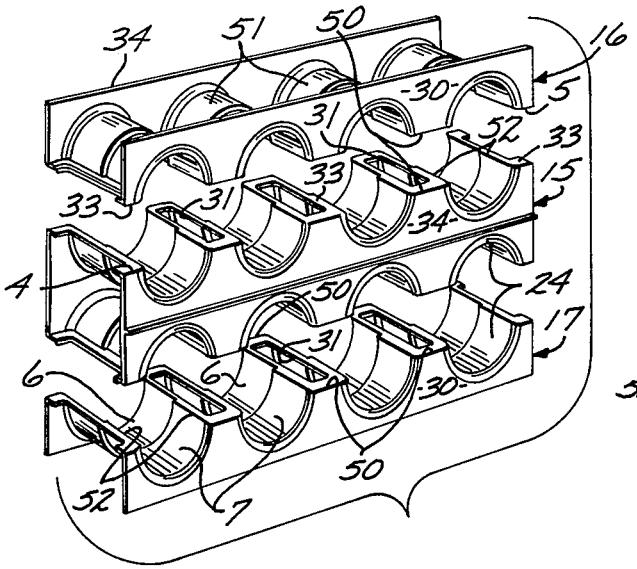
FIG. 1
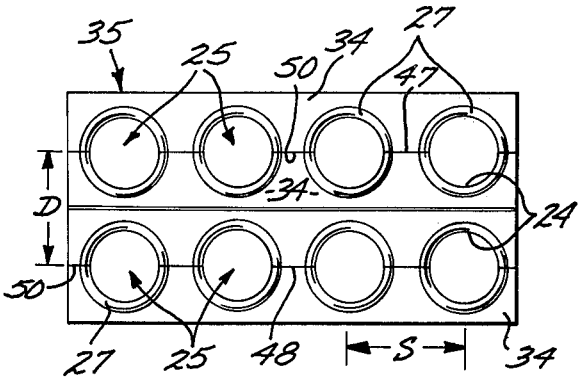
FIG. 2
FIG. 5
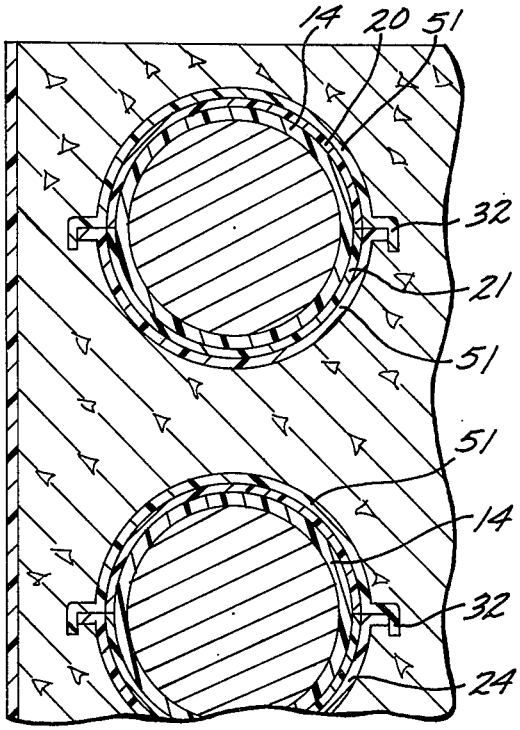
FIG. 4
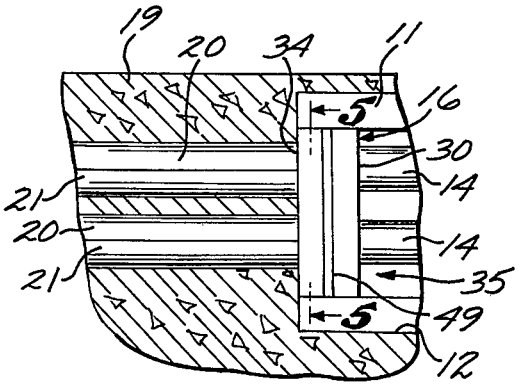

SPLIT DUCT TERMINATOR

BACKGROUND OF THE INVENTION

The present invention relates to apparatus for terminating a plurality of subterranean cables at the entrance to a cable manhole formed of concrete and buried beneath the surface. Such manholes, though designed to be water resistant, eventually do develop leaks, typically in the wall through which the cables enter. In the replacement of such manhole walls, it is highly desireable to maintain the cables entering the manhole in position and in service. In manhole reconstruction the old wall is destroyed and the cable is temporarily supported by a combination of frameworks and wires between the manhole appearances and the splice box. Thereafter a new wall is constructed in place of the old wall. The sections of cable between manholes are protected by sections of split duct positioned about the cables. The split duct must be terminated at the new wall. According to the present invention, the split duct terminator modules are assembled about the cables in modular units and are thereafter joined together by a solvent cement. A coagulated mass is then formed within the framework constructed from the modules to permeate the entire structure of the interfacing split duct terminator modules. The structure formed receives the split duct sleeves positioned about the cables as they enter the manhole. This allows a new wall to be constructed about the cables without disconnecting the cables or otherwise interrupting service in them.

A very substantial part of the electrical communication network operated and owned by telephone and telegraph companies exists in the form of subterranean electrical signal cables lying beneath the ground. These subterranean cables each contain a great number of message conductors and are interconnected at central offices spaced at periodic intervals. Between the central offices, manholes are provided at intervals determined by the length of cable which can be conveniently and economically wound onto a reel. Access to the manholes is provided for purposes of maintenance, servicing and inspection. Between the manholes, sections of split duct are laid end to end in trenches and cables are drawn through the duct sections. The subterranean manholes are typically formed of concrete and are designed for permanent installation. However, over the years, shifting of the earth about the manholes, soil subsidence, temperature changes, and the formation of ice in crevices in the structure of the manholes all operate to cause damage to the manhole structure. The most frequent form of damage caused by these effects is degradation of service resulting from water leakage in the manholes. For these and other reasons, it is desirable to replace cracked, damaged, and otherwise substandard manholes by building upon the old structure to provide new water resistant manholes.

Because of the requirement for making manholes as water resistant as possible it has been necessary to develop a means of recasting a manhole wall without disconnecting from service or moving the cables that enter the manhole. The split duct terminator of this invention provides such a means.

As an incident of replacement, it is also frequently desireable to expand the area of the manhole both to allow sufficient room for ease of movement by individuals replacing the manhole so as to minimize the risk of damage to the cables appearing therein as well as to accommodate additional conduits or amplifier or repeater equipment which may be desired.

Extreme caution is required in order to replace a manhole without interrupting the service in the communications lines passing through it. Since the number of communications circuits accommodated by a single pair of wires has multiplied over the years, the disruption of communications which would result from the severance of a single cable containing a number of electrical connector pairs is very substantial.

SUMMARY OF THE INVENTION

It is a principal object of the invention to provide a duct terminator without requiring the removal or relocation of the cables which are maintained in service during the duct terminator construction. This is achieved with no interruption in service in the lines within the cables.

It is another object of the present invention to provide apparatus which may readily be maneuvered into position to immobilize subterranean conduits or ducts in a manhole and which, after positioning, may be united to form a cohesive structure which confines the ducts and cables carried therein in position relative to each other.

It is a further object of the invention to provide means useful in the replacement of subterranean manholes which may be employed to expand the perimeter of a manhole yet which at the same time will facilitate protection of the lengths of cable which are thereby exposed between the boundaries of the expanded vault and those of the original vault. A related object of the invention is the provision of apparatus for quickly securing split duct sections in place about the exposed cables to provide such protection and to prevent interruptions in service due to damage incurred in manhole reconstruction.

BRIEF DESCRIPTION OF THE DRAWINGS

FIG. 1 is an exploded perspective view of modular members of the terminator apparatus;

FIG. 2 is a front elevational view of the elements of FIG. 1 positioned adjacent to each other;

FIG. 4 is a side elevational view depicting the entrance of subterranean conduits into the composite split duct terminator structure; and FIG. 5 is a sectional view taken along the lines 5—5 of FIG. 4.

DETAILED DESCRIPTION OF THE INVENTION

Figure 3:
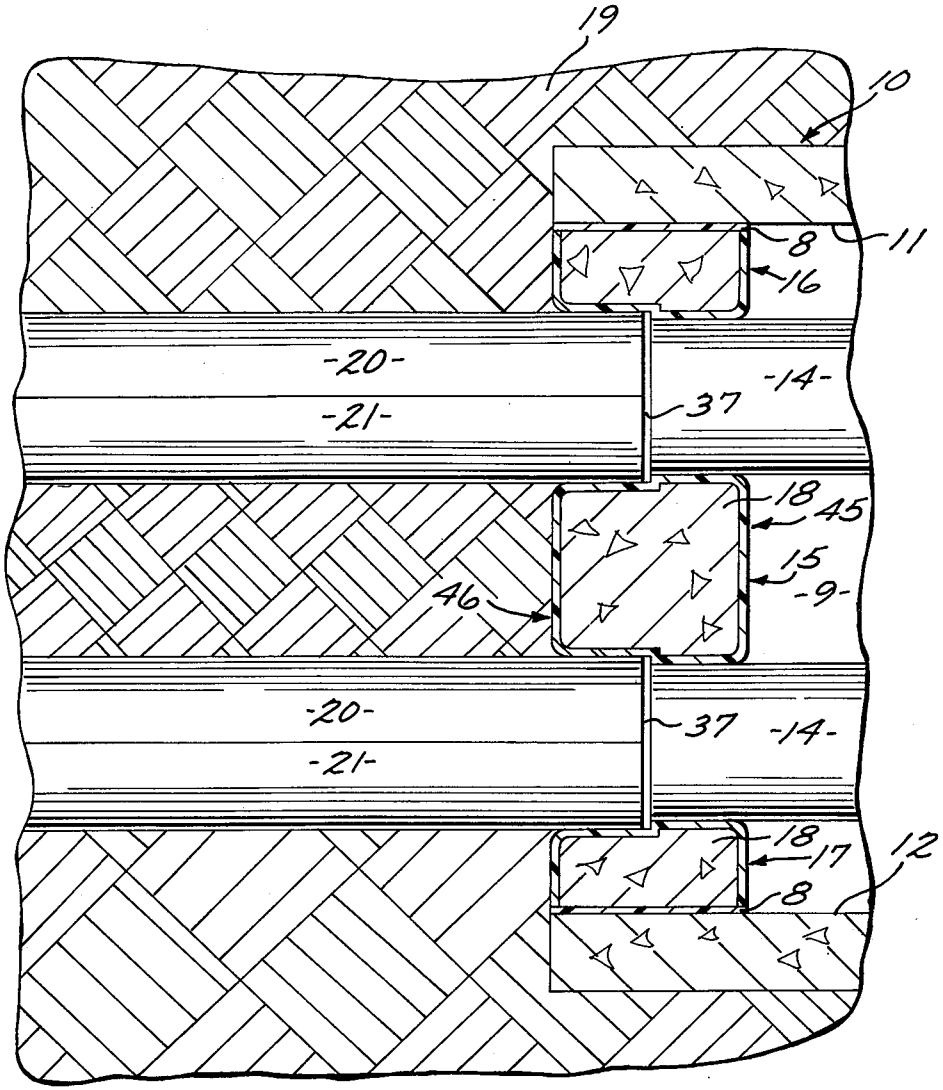
FIG. 3 is a side elevational sectional view of the cable entrance to a cable vault reconstructed using the apparatus of the present invention.

In one broad aspect, this invention is split duct terminator apparatus for terminating a plurality of subterranean cables comprising a plurality of modular members 15, 16 and 17 each including a pair of longitudinally extending opposing wall elements 30 and 35 and having at least one pair of mutually coextensive module interface edges 50 which lie in a common modular element interface plane that intersects the wall elements. The surfaces 33 lie in such a common interface plane between modules. A plurality of symmetrical, longitudinally spaced, parallel channel elements 51 extend between opposing wall elements 30 and 34. The edges 52 of the channel elements lie in the modular element interface plane to define a plurality of longitudinally spaced apart open channels 24 concave with respect to the modular element interface plane. The longitudinal spacing between channel elements defines symmetrical openings 31 therebetween. The disposition of modular members in face to face relationship positions the modular interface edges 50 of the wall elements of each member in mutual contact and the modular interface edges 52 of channel elements of each member in mutual contact. This composite framework created by the assembled modules 15, 16 and 17 has passageways 25 formed by adjacent channels 24 in the members which extend between the wall elements, and is employed in a manner hereinafter to be described.

In the reconstruction of a concrete manhole to remedy leaks therein, earth is first removed from atop a conventional plastic or ceramic cable guide adjacent to the old wall of the manhole. The cable guide normally defines an array of passageways of square or circular cross section which abut the old wall of the cable vault and extend laterally outward therefrom. Each of the passageways in the cable guide accommodates a single conduit. Once the earth is removed from atop one or more of the adjacent sections of the cable guide the cable is exposed by breaking the cable guide with care so as to avoid damage to the cables contained within the cable guide. At this point, in the reconstruction the cables are most vulnerable as they are unsheathed and unprotected. The bare cables are then supported and immobilized by means of frameworks and wires in order to hold the cables in position without disconnecting them or otherwise interrupting telephone service within them. The old wall through which the cables pass is then broken away with care. It is highly advantageous to erect protection for the cables rapidly and with as little manipulation as possible so that they may be continuously maintained in service. This is achieved with the apparatus of the present invention.

Once the cables have been exposed and the rubble of the old wall and broken cable guide have been removed, along with any earth that may have fallen in on the cables the reconstruction may proceed. Each of the modular split duct terminator members 15, 16 and 17 is separately maneuvered into place so that the cables 14 are encircled by passageways 25 formed by the channels 24 in the mating surfaces 33 of adjacent modular elements. Solvent cement is applied to the surfaces 33 and the modules are banded together with metal or plastic banding material 49. The banded structure 35 is then slid along the cables 14 into the position where the new wall is to be erected, as at the edge of concrete slab 12 in FIGS. 3 and 4. Split duct halves 20 and 21 can then be positioned about the cables 14 and slid toward the split duct terminator structure until they are seated in the cylindrical wall portions 6 of the passageways 25, preferably abutting gaskets 37 which have previously been inserted. The gaskets 37 may be in the form of a split rubber ring or a coating of sealer inserted into the annular space defined between the larger diameter portion of the passageway 25 and the conduits 14. This sealing means or gasket is compressed against the shoulder 27 by insertion into the cylinder 6 of the split duct halves 20 and 21. The split duct halves 20 and 21 are then secured to each other with metal or plastic banding material. Concrete in an uncured state is poured into the framework formed by the banded modules 15, 16 and 17. A concrete roof 11 is thereafter laid in position and tar or pitch 8 or other waterproofing material is calked into the cracks between the split duct terminator modules and the walls, floor and roof of the manhole.

The essence of the present invention is the provision of a split duct terminator which does not require the removal, relocation, disconnection or interruption of service to circuits in the cables 14 during manhole reconstruction. As was previously explained, one or more lengths of cable guide must be removed adjacent to the original wall of the manhole while the rest of the cable guide sections remain in place buried in the soil 19. The split duct sections 20 and 21 must be interfaced with the adjacent unbroken cable guide section.

Each of the members 15, 16 and 17 includes a pair of longitudinally extending opposing wall elements 30 and 34 having at least one pair of mutually coextensive module interface edges 50 which lie in a common modular element interface plane that intersects the wall elements. Each of the members 15, 16 and 17 also includes at least one lateral mating surface 33 positioned in face-to-face relationship with a lateral mating surface of an adjacent module at a modular element interface plane. Formed in the mating surfaces 33 are a plurality of symmetrical, longitudinally spaced parallel channel elements 51 defining a plurality of grooves or channels 24. These grooves or channels 24 are open and spaced apart longitudinally and are concave with respect to the modular element interface plane where adjacent mating surfaces 33 of adjacent modular members are positioned in face-to-face contact. The channel elements 51 defining the channels 24 extend between opposing wall elements 30 and 34 of each modular member.

As can be seen with reference to FIG. 1, the upper modular member 16 and and the lower modular member 17 include only a single mating surface 33. However the interior modular member 15 is constructed with two mating surfaces 33, one on the top and one on the bottom. Into each such surface a plurality of channel elements forms an array of grooves 24 as previously described. Preferably, as can be seen from FIG. 2, the distance D between the planar module interfaces 47 and 48 of the mating surfaces is equal to the spacing S of the grooves 24 in each of the arrays of grooves. Opposing wall elements 30 and 35 are perpendicular to the alignment of the grooves 24 and intersect the mating surface or surfaces 33 of the modular member with which they are associated at edges 50. The wall members 30 and 35 thereby extend at least from their juncture with the grooves 24 and terminate at either or both of the planar module interfaces 47 and 48 where the mating surfaces 33 of adjacent ones of the modular elements lie together in face-to-face relationship. The end surfaces 30 and 34 together form vertical walls 45 and 46, as indicated in FIG. 3, when a series of elements 15, 16 and 17 are positioned adjacent to each other as in FIG. 2. The longitudinal spacing between channel elements defines symmetrical openings therebetween. When in this position, with modular interface edges, such as the edges 50 of opposing wall elements 30 and 34, in mutual contact with modular interface edges 50 of the wall elements 30 and 34 of another modular member positioned together in mutual contact, a composite structure 35 is formed having passageways 25 formed by adjacent channel elements extending between the wall elements 30 and 34.

To position the modules of the split duct terminator apparatus about cables 14, the lower modular member 17 is maneuvered into place so that the cables 14 lying adjacent thereto pass through the grooves 24 in module 17. Thereafter, an interior module 15 is maneuvered into position so that the cables 14 in the lowest level of conduits are completely encircled in the passageways 25 and so that the grooves 24 on the upper surface of the modular member 15 are in position to receive the next row of laterally extending cables 14 at the next higher level. The composite structure 35 is thereby built up in this manner until all of the cables 14 in each vertical row of cables pass through passageways 25. The last modular member positioned in place is the upper member 16.

One further feature of the various modules 15, 16 and 17, which should be noted is the existence of apertures 31 which are defined in the portions of the mating surfaces 33 which are in mutual contact with adjacent portions 33 on adjacent modules. These apertures provide access to the interior of the modules. The channel elements, defining the channels 24, are uniformly spaced so that apertures 31 are defined therebetween. The apertures 31 of adjacent surfaces 33 provide a vertical path of communication within the structure 35. In addition to being aligned, the apertures or openings 31 in the mating surfaces 33 are divided into two classes. A first class of apertures 31 are those apertures located on the undersides of the various modular members 15 and 16. These apertures have in association therewith uniformly spaced alignment projections 32 which extend downwardly normal to the mating surface 33 from the underside of the modular elements 15 and 16. These projections 32 are in the form of lips or flanges which extend around the perimeters of the uniformly spaced openings 31. The projections 32 are received in the symmetrical openings 31 in other mating surfaces. The openings 31 which receive the projections 32 form the other class of apertures which are those apertures located on the upper surfaces of the modular members 15 and 17 at the mating surfaces 33. The projections 32 thereby facilitate the positioning of the various modular elements in alignment, as depicted in FIG. 5. While in this position with the cables 14 passing through the passageways 25, it can be seen that uncured concrete mix poured into the top of the composite structure 35, will pass down through the apertures 31 from the upper element 16 through the interior element 15 and down into the lower element 17. Thus, such concrete can permeate the entire structure 35 and when coagulated, bind the individual modular elements 15, 16 and 17 of the structure 35 together in a cohesive mass. As the concrete cures, it coagulates into a mass 18 that extends through the apertures 31 to the interior of all of the modules 15, 16 and 17. The concrete extends between the opposing vertical walls 45 and 46 formed by the wall elements 30 and 34 of the several modules to join the modules together and surround the passageways 25 formed by the structure.

Once the wall structure 35 has been built a concrete slab 11 covering up the manhole is laid in place as depicted in FIG. 3. This concrete slab 11 would typically have an opening for a manhole for access to the interior of the vault 9. A water tight seal of the new wall 35 is formed by calking the split duct terminator structure 35 with pitch or tar 8 where joints are formed with the slab 11, the floor 12 and the concrete walls of the manhole.

The foregoing detailed description of the manner of construction of the preferred form of the invention depicted has been described for purposes of illustration only, and no unnecessary limitations should be construed therefrom, since other modifications and embodiments will become readily apparent to those familiar with the field of the invention. For example, while but a single interior module 15 has been depicted, it is apparent that an additional interior module 15 will be required for each additional vertical row of conduits 14 that exist beyond those illustrated.

I claim:

1. Split duct terminator apparatus for terminating a plurality of subterranean cables comprising a plurality of module members, each member including a pair of longitudinally extending upright opposing wall elements having at least one pair of mutually coextensive module interface edges which lie in a common laterally extending modular element interface plane that intersects said wall elements, a plurality of symmetrical longitudinally spaced parallel channel elements extending between said opposing wall elements and the edges of which lie in said modular element interface plane to define a plurality of spaced apart channels concave with respect to said modular element interface plane and wherein the longitudinal spacing between said channel elements defines symmetrical openings therebetween, and further including alignment projections uniformly spaced in the direction of spacing between said channel and extending outwardly from at least some of said modular members normal to said module interface plane, and which are received by corresponding recesses in others of said module members positioned adjacent thereto, whereby the disposition of modular members in face to face relationship with modular interface edges of the wall elements of each member in mutual contact and modular interface edges of channel element of each member in mutual contact and the provision of said alignment projections disposed within said recesses to laterally immobilize said modular elements relative to each other creates a composite structure having passageways formed by adjacent channels in said members and extending between the aforesaid wall elements.

2. The split duct terminator apparatus of claim 1 wherein said projections are lips which extend around the perimeters of a first class of said symmetrical openings and said projections are received in a second class of symmetrical openings in others of said modular members.

3. The split duct terminator apparatus of claim 1 wherein the wall elements of at least some of said modular members are constructed with two pairs of module interface edges as aforesaid, and separate corresponding sets of a plurality of symmetrical longitudinally spaced parallel channel elements extend between said wall elements as aforesaid in association with each pair of module interface edges so that the module interface edges of the channel elements in one set lie in a common module interface plane with the module interface edges of said wall elements in one of said pairs, and the module interface edges of said wall elements in said other pair lie in a separate modules interface plane parallel to the first.

4. The split duct terminator apparatus of claim 3 wherein the passageways formed by adjacent channels in said members are in the shape of abutting coaxial right cylinders of different diameters, whereby an annular shoulder is formed in said passageways between opposing wall elements and parallel thereto.

5. A subterranean conduit termination structure comprising a plurality of split duct terminator modules each including at least one lateral mating surface positioned in face-to-face relationship with a lateral mating surface of an adjacent module and into which is formed a plurality of evenly spaced, symmetrical, parallel channels concave with respect to portions of said mating surface which lie between said channels and in contact with corresponding portions of a mating surface of an adjacent module, and wherein one mating surface in a pair of mating surfaces positioned face to face has upright alignment projections extending therefrom and uniformly spaced in the direction of spacing between said channels, and said projections are received in corresponding recesses in the other mating surface in said pair, and wherein opposing vertical end surfaces of each module are perpendicular to the alignment of said channels and together form opposing vertical walls through which passageways formed by adjacent ones of said channels in adjacent facing modules appear, and uniformly spaced and aligned apertures are defined in mating surfaces at areas thereof which are in mutual contact, and a coagulated mass extends through said apertures to the interior of said modules and extends between said opposing vertical walls to join said modules together and encircle the passageways formed through said structure.

6. The subterranean conduit termination structure of claim 5 wherein said channels in adjacent facing modules form passageways between said vertical walls in the shape of abutting coaxial right cylinders of different diameters, whereby an annular shoulder is formed in said passageways between said vertical walls.

* * * * *

UNITED STATES PATENT OFFICE

CERTIFICATE OF CORRECTION

Patent No. 4,075,803 Dated February 28, 1978

Inventor(s) John Alesi, Jr.

It is certified that error appears in the above-identified patent and that said Letters Patent are hereby corrected as shown below:

Column 2, line 59 delete "35" and substitute therefor --34--

Signed and Sealed this

*Twenty-ninth* Day of *January 1980*

[SEAL]

*Attest:*

SIDNEY A. DIAMOND

*Attesting Officer*

*Commissioner of Patents and Trademarks*